US009809983B2

(12) United States Patent
Trudel

(10) Patent No.: US 9,809,983 B2
(45) Date of Patent: Nov. 7, 2017

(54) PIVOTABLY DETACHABLE HARDWOOD FLOORBOARDS

(75) Inventor: Pierre Trudel, Notre-Dame-du-Mont-Carmel (CA)

(73) Assignee: RENE ST-CYR (1996) INC., Notre-Dame-du-Mont-Carmel, QC (CA)

( * ) Notice: Subject to any disclaimer, the term of this patent is extended or adjusted under 35 U.S.C. 154(b) by 397 days.

(21) Appl. No.: 12/871,219

(22) Filed: Aug. 30, 2010

(65) Prior Publication Data

US 2011/0016818 A1 Jan. 27, 2011

Related U.S. Application Data

(63) Continuation of application No. PCT/CA2008/001206, filed on Jun. 27, 2008.

(30) Foreign Application Priority Data

Mar. 7, 2008 (CA) ..... 2623707

(51) Int. Cl.
*E04B 2/00* (2006.01)
*E04F 15/04* (2006.01)
*E04F 15/02* (2006.01)

(52) U.S. Cl.
CPC ..... *E04F 15/04* (2013.01); *E04F 15/02038* (2013.01); *E04F 2201/0153* (2013.01)

(58) Field of Classification Search
CPC ..... E04F 15/04; E04F 15/02038; E04F 2201/0153
(Continued)

(56) References Cited

U.S. PATENT DOCUMENTS 2,269,927 A * 1/1942 Crooks ..... 52/390
4,599,842 A * 7/1986 Counihan ..... 52/586.2
(Continued)

FOREIGN PATENT DOCUMENTS

CA 2319723 12/1999
DE 202007007473 8/2007
(Continued)

OTHER PUBLICATIONS

Supplementary European Search Report, corresponding EP application EP08172859, dated Apr. 14, 2016.

*Primary Examiner* — Brian Glessner
*Assistant Examiner* — Joshua Ihezie
(74) *Attorney, Agent, or Firm* — Norton Rose Fulbright Canada LLP

(57) ABSTRACT

A floorboard assembly comprises first and second solid wood floor boards (10) and (12). The first floor board (10) has a tongue (14) extending longitudinally along a first side thereof. The second floor board (12) having a groove (16) extending longitudinally along a second side thereof. The groove (16) has a width defined between a top lip (22) and a bottom lip (24). The tongue (14) is insertable in a tight fit manner in the groove (16) to prevent translational separation of the boards (10, 12) in a common plane thereof. A clearance (26, 26', 28, 32, 32', 32", 36 and 38) is provided between the tongue (14) and the groove (16) at one of a tip portion of the tongue (14) and an outermost portion of the top and bottom lips (22, 24) of the groove (16). The clearance (26, 26', 28, 32, 32', 32", 36 and 38) is configured to allow angular withdrawal of the tongue (14) from the groove (16) by manually pivoting the first and second floor boards (10, 12) towards one another in one of an upward and a downward direction.

20 Claims, 6 Drawing Sheets

(58) Field of Classification Search
USPC ..... 52/591.1, 591.2, 591.3, 589.1
See application file for complete search history.

(56) References Cited

U.S. PATENT DOCUMENTS

| | | | | |
|---|---|---|---|---|
| 5,216,861 | A * | 6/1993 | Meyerson | 52/586.2 |
| 5,502,939 | A * | 4/1996 | Zadok et al. | 52/309.9 |
| 5,540,025 | A * | 7/1996 | Takehara et al. | 52/403.1 |
| 5,570,554 | A * | 11/1996 | Searer | 52/539 |
| 5,618,602 | A * | 4/1997 | Nelson | 428/60 |
| 6,029,416 | A * | 2/2000 | Andersson | 52/592.1 |
| 6,182,413 | B1 * | 2/2001 | Magnusson | 52/589.1 |
| 6,209,278 | B1 | 4/2001 | Tychsen | |
| 6,247,285 | B1 * | 6/2001 | Moebus | 52/589.1 |
| 6,324,809 | B1 * | 12/2001 | Nelson | 52/592.2 |
| 6,397,548 | B1 * | 6/2002 | Martin et al. | 52/592.4 |
| 6,421,970 | B1 * | 7/2002 | Martensson et al. | 52/282.1 |
| 6,490,836 | B1 | 12/2002 | Moriau et al. | |
| 6,505,452 | B1 | 1/2003 | Hannig et al. | |
| 6,526,719 | B2 * | 3/2003 | Pletzer et al. | 52/592.2 |
| 6,581,351 | B2 * | 6/2003 | DeVivi | 52/592.1 |
| 6,606,834 | B2 * | 8/2003 | Martensson et al. | 52/578 |
| 6,637,169 | B2 * | 10/2003 | Niese et al. | 52/480 |
| 6,675,544 | B1 * | 1/2004 | Ou et al. | 52/539 |
| 6,681,820 | B2 * | 1/2004 | Olofsson | 144/368 |
| 6,682,254 | B1 * | 1/2004 | Olofsson et al. | 403/375 |
| 6,823,638 | B2 | 11/2004 | Stanchfield | |
| 6,851,237 | B2 * | 2/2005 | Niese et al. | 52/480 |
| 6,968,664 | B2 * | 11/2005 | Thiers et al. | 52/592.1 |
| 7,003,925 | B2 | 2/2006 | Pervan | |
| 7,137,229 | B2 * | 11/2006 | Pervan | 52/313 |
| 7,188,456 | B2 * | 3/2007 | Knauseder | 52/592.1 |
| 7,441,384 | B2 * | 10/2008 | Miller et al. | 52/589.1 |
| 7,484,337 | B2 * | 2/2009 | Hecht | 52/578 |
| 7,644,556 | B2 * | 1/2010 | Grohman et al. | 52/592.1 |
| 2002/0095894 | A1 * | 7/2002 | Pervan | 52/391 |
| 2002/0170258 | A1 * | 11/2002 | Schwitte et al. | 52/592.1 |
| 2003/0041545 | A1 * | 3/2003 | Stanchfield | 52/592.1 |
| 2003/0101674 | A1 * | 6/2003 | Pervan et al. | 52/592.1 |
| 2003/0154681 | A1 * | 8/2003 | Pletzer et al. | 52/578 |
| 2003/0205017 | A1 * | 11/2003 | Palmberg | 52/592.1 |
| 2003/0208980 | A1 * | 11/2003 | Miller et al. | 52/592.1 |
| 2004/0035078 | A1 * | 2/2004 | Pervan | 52/589.1 |
| 2004/0168392 | A1 * | 9/2004 | Konzelmann et al. | 52/589.1 |
| 2006/0010820 | A1 * | 1/2006 | Schwitte et al. | 52/592.1 |
| 2007/0022695 | A1 * | 2/2007 | Magnusson | 52/592.1 |
| 2008/0148674 | A1 * | 6/2008 | Thiers et al. | 52/592.1 |
| 2009/0077919 | A1 * | 3/2009 | Fam | 52/592.1 |

FOREIGN PATENT DOCUMENTS

| | | |
|---|---|---|
| WO | WO03/122224 | 2/2003 |
| WO | WO2007117422 | 10/2007 |

* cited by examiner

PIVOTABLY DETACHABLE HARDWOOD FLOORBOARDS

RELATED APPLICATION(S)

The application is a continuation of International Patent Application No. PCT/CA2008/001206 filed on Jun. 27, 2008, which claims benefit of Canadian Patent Application No. 2,623,707 filed on Mar. 7, 2008, which are herein incorporated by reference.

FIELD OF THE INVENTION

The application relates generally to hardwood floorboard assemblies and, more particularly, to a new hardwood flooring tongue and groove arrangement.

BACKGROUND ART

In the hardwood floor industry, two main types of hardwood floor are found on the market, 1) solid wood and 2) engineered wood composed of superposed layers of wood. Solid hardwood floorboards are manufactured pre-finished or unfinished. In the pre-finished hardwood floor, the sanding and varnishing process is done at the factory by opposition to the unfinished flooring where the sanding and varnishing are executed on-site after installation of the hardwood flooring.

The manufacturing process of pre-finished hardwood floor includes varnishing and/or staining steps on assembled floorboard sections of typically 4 feet wide. These sections allow effective use of sanding techniques prior to or concomitant with the varnishing and/or staining steps. There is a need for the manufacturers, to have a tight assembly of the tongue and groove joint between each adjoining floor hoards to prevent the same from becoming disassembled from one another during the sanding and varnishing process.

During the varnishing process, the floorboards can be assembled and disassembled 2 to 3 times prior to its final packaging. The manufacturers also traditionally packed the floorboards in 4 layers of 3 or 4 wide assembled floorboard panels. There is thus also a need for facilitating the separation of the floor boards into layers of 3 or 4 assembled floorboard panels without damaging the tongue and groove joint.

The requirement of having a tight assembly of the tongue and groove joint during the sanding operation is a major inconvenient for floorboards installers who need to disassemble the floorboard packages before the installation. If excessive force is used to separate the floorboards, especially those who were exposed to humidity, by applying excessive force, it may cause permanent damage to the tongue and groove joint and/or result in an increase of disassembling time and efforts for the installers.

None of the traditional floorboards are designed to provide a solid board assembly to prevent disengagement of the individual floor boards during the factory sanding process while still providing for easy disassembly of the pre-finished floorboards into floorboard sections of 3 or 4 floorboard panels prior to packaging and/or into individual floor boards prior the installation. If prior-art tongue and groove designs were made to ease detachment of floorboards, they could not insure a tight assembly during the manufacturing or installation.

There is thus a need to provide floorboards with tight assembly of the tongue and groove joint for the manufacturing process while remaining easy to detach at the time of installing the hardwood flooring.

SUMMARY

In view of the foregoing, it would be desirable to provide a tightly assembled tongue and groove joint to prevent individual floorboards from being disassembled during factory sanding and varnishing operations while providing for relatively easy manual separation of the boards by the contractor at the time of installation.

Those contradictory requirements can be met for a tongue-and-groove design that provides a firm grip and a tight assembly of floorboards to insure quality of processing at varnishing, while allowing ease of disassembling by a simple rotational or pivotal movement of the floorboards to ease the work of the installer without modifying the traditional way of installation.

According to a general aspect, there is thus provided a floorboard assembly comprising: at least first and second hardwood floor boards adapted to be mounted in a side-by-side coplanar relationship, the first floor board having a tongue extending longitudinally along a first side thereof, the second floor board having a groove extending longitudinally along a second side thereof, the groove having a width defined between a top lip and a bottom lip, the tongue being received in a tight fit manner in the groove to provide frictional resistance against translational separation of the first and second floor boards in a common plane thereof, a top surface of the tongue being in frictional engagement with an undersurface of the top lip of the groove from a top outermost contact point to a top innermost contact point, a bottom surface of the tongue being in frictional engagement with a top surface of the bottom lip of the groove from a bottom outermost contact point to a bottom innermost contact point, the top outermost contact point and the bottom innermost contact point defining a first diagonal, the top innermost contact point and the bottom outermost contact point defining a second diagonal, one of said first and second diagonals having a length sufficiently greater than the width of the groove to substantially lock the first and second floor boards against relative pivotal movement in one of an upward or a downward direction associated with said one of said first and second diagonals, and a clearance provided between the tongue and the groove, the clearance reducing the length of the other one of said first and second diagonals to approximate the width of the groove to permit an angular withdrawal of the tongue from the groove by manually pivoting the first and second boards toward each other in the other one of said upward and downward directions.

According to a further general aspect, there is provided a pre-finished floorboard assembly comprising at least first and second solid wood floor boards, the first floor board having a tongue extending longitudinally along a first side thereof, the second floor board having a groove extending longitudinally along a second side thereof, the groove having a width defined between a top lip and a bottom lip, the tongue being insertable in frictional engagement in the groove to counteract pull-apart forces exerted on the first and second floor boards during factory sanding and varnishing operations, and at least one play provided between the tongue and the groove at one of a tip portion of the tongue and an outermost portion of the top and bottom lips of the groove, the play being configured to allow the tongue to be angularly withdrawn from the groove by manually pivoting the first and second floor boards towards one another in only one of an upward and a downward direction.

The term "floor board" should not be strictly construed to the preliminary meaning of the word and is intended to broadly refer to any floor planks, floor strips and the like used in the fabrication of a hardwood flooring.

Floor boards can be made from different hardwood essence, such as pin, oak, maple, wild cherry, cherry, birch and walnut. It is understood that the present invention is not limited to only those commonly available wood species.

BRIEF DESCRIPTION OF THE DRAWINGS

Reference will now be made to the accompanying drawings in which.

DESCRIPTION OF THE PREFERRED EMBODIMENTS

Figure 1:
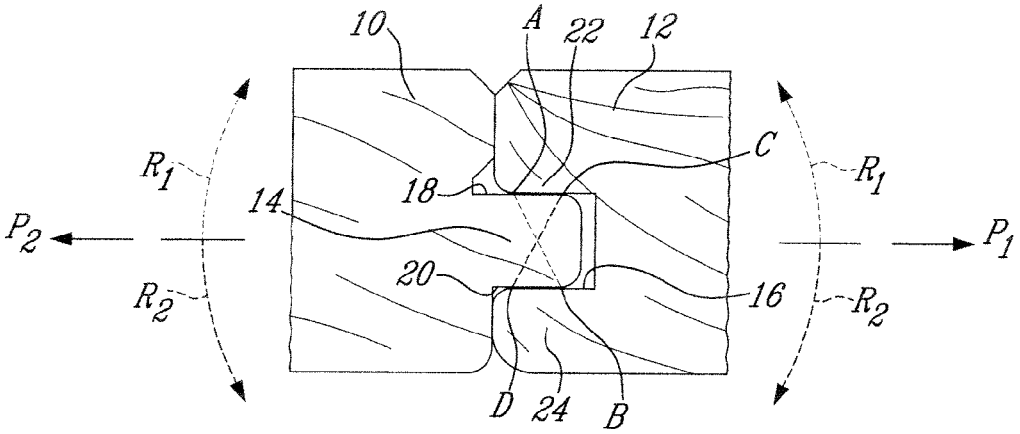
FIG. 1 (PRIOR ART)
FIG. 1 is a cross-sectional view of a prior art hardwood floorboard assembly illustrating a tongue-and-groove interconnection between two adjacent solid wood planks.

FIG. 1 shows a prior art tongue and groove joint of the type used to interconnect solid wood boards in a coplanar relationship to form hardwood flooring. More particularly, FIG. 1 shows first and second adjoining floor boards 10 and 12. Each floor board panel 10, 12 has a tongue 14 extending axially along a first longitudinal side thereof and a groove 16 extending axially along an opposite longitudinal side thereof for receiving the tongue 14 of an adjacent floor board, as is well know in the art. As shown in FIG. 1, the tongue 14 of the first floor board 10 is frictionally engaged in the groove 16 of the second floor board 12 in order to maintain the first and second floor boards 10 and 12 in a coplanar side-by-side relationship. The tongue 14 has parallel top and bottom surfaces 18 and 20 which are respectively in frictional engagement with the top and bottom lips 22 and 24 of groove 16. As can be appreciated from FIG. 1, the top outermost contact point A, between the tongue top surface 18 and the groove top lip 22, and the diagonally opposed bottom innermost contact point B, between the tongue bottom surface 20 and the groove bottom lip 24, cooperate to lock the first and second floor boards 10 and 12 against relative upward pivotal movement, as depicted by arrows $R_1$. The length of line AB is too great as compared to the width of the groove 16 (i.e. the distance between the top and bottom lips 22 and 24) to permit any upward pivotal or tilting movement of the tongue 14 in the groove 16. Likewise, the top innermost contact point C, between the tongue top surface 18 and the groove top lip 22, and the diagonally opposed bottom outermost contact point D, between the tongue bottom surface 20 and the groove bottom lip 24, cooperate to lock the first and second floor boards 10 and 12 against relative downward pivotal movement, as depicted by arrows $R_2$. Again, the length of line CD is significantly greater than the width of the groove 16, thereby preventing downward pivotal movement of the tongue 14 in the groove 16 and that even for soft wood species exhibiting relatively high level of compressibility. The difference between the length of lines AB and CD and the width of the groove 16 is simply too important to allow any upward or downward pivotal movement of the tongue 14 in the groove 16. By analogy, it would be like trying to fit a 6 feet long vertical beam between 5 feet spaced-apart top and bottom beams.

Accordingly, the only way of disassembling the floor boards 10 and 12 without breaking the tongue 14 or the lips 22, 24 of the groove 16 is to pull apart the boards 10 and 12 by applying withdrawal forces in the plane of the boards 10 and 12 in a direction opposite to a direction of insertion of the tongue 14 in the groove 16, as depicted by arrows $P_1$ and $P_2$. The top and bottom frictional surfaces respectively defined between: 1) top contact points A and C and 2) bottom contact points D and B, provide resistance against the linear withdrawal of the tongue 14 from the groove 16. It can be appreciated that the distance between top contact points A and C is equal to the distance between bottom contact points D and B. The tighter the fit between the tongue 14 and the groove 16, the greater the forces $P_1$ and $P_2$ must be to separate the floor boards 10 and 12. A tight fit is particularly desirable where the floor boards are to be pre-finished (factory finished). If a loose fit is provided, the boards run the risk of becoming disengaged from one another during the sanding and varnishing procedures, thereby resulting in poor quality finish. However, once on-site, it is desirable for the boards to be easily separable to facilitate the installation thereof. The above tongue and groove joint arrangement with planar disengagement of the boards does not meet the above contradictory needs. Therefore, compromises had heretofore to be made between a good quality finish and easy installation.

Figure 2:
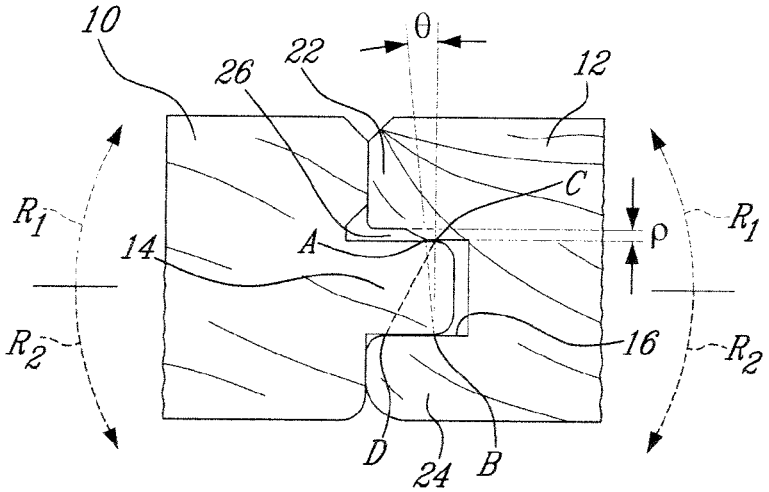
FIG. 2 is a cross-sectional view of a hardwood floorboard assembly illustrating a lip clearance angle of a tongue and groove joint between two adjoining floor boards in accordance with an embodiment of the present invention.

Turning to FIG. 2, there is shown an embodiment of a new tongue and groove joint which still provides resistance against coplanar disengagement of the floor boards 10 and 12 while allowing easy separation of the floor boards 10 and 12 by a simple upward pivotal action. As will be seen hereinafter, the tongue and groove joint has been modified to permit an upward pivoting or tilting movement of the tongue 14 in the groove 16, thereby allowing easy withdrawal of the tongue 14 from the groove 16.

Figure 5A:
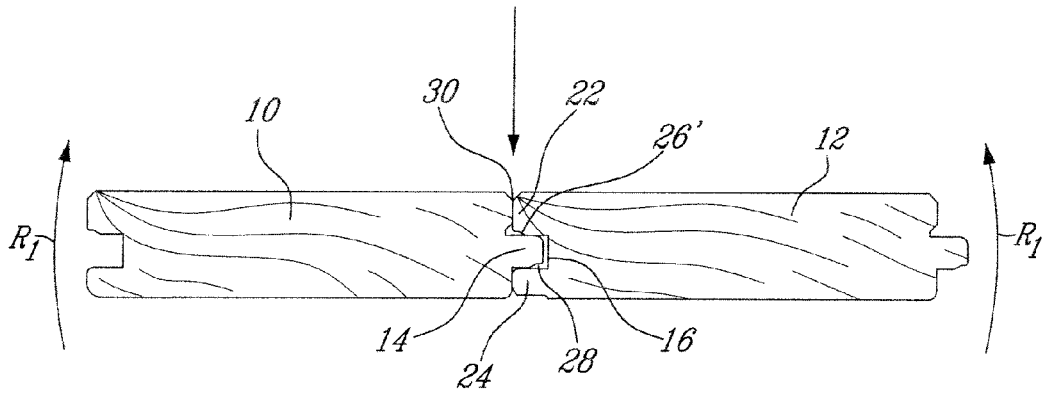
FIGS. 5*a* to 5*c* are cross-sectional views illustrating in sequence the pivotal disengagement of the floor boards shown in FIG. 3.
Figure 5B:
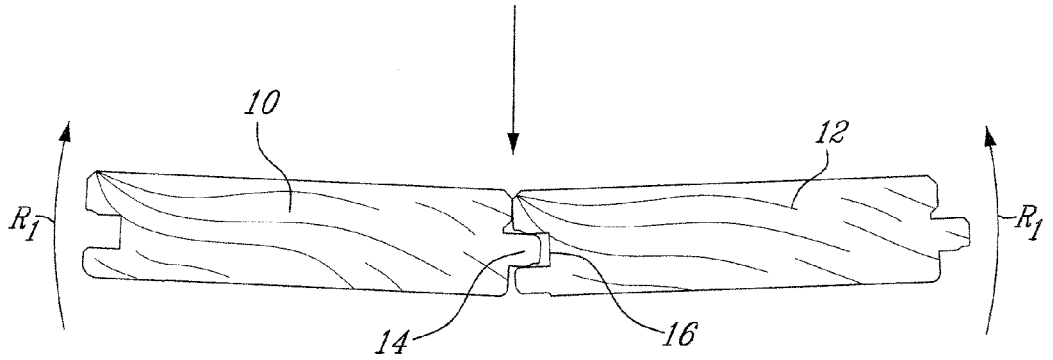
Figure 5C:
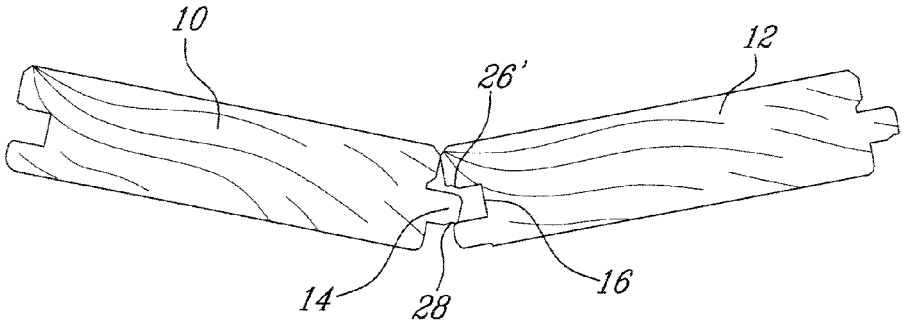

It can be appreciated from FIG. 2, that the length of diagonal line AB can be shortened, for instance, by displacing the top outermost contact point A inwardly towards the bottom of the groove 16 (towards the right hand side on FIG. 2). By doing so, line AB is pivoted about the innermost bottom point B to a position closer to the vertical, thereby resulting in a shortening of the line AB to a dimension which is closer to the width of the groove B. When the length of line AB is sufficiently close to the width dimension of the groove 16, it becomes possible to disengage the floor boards 10 and 12 by simply pivoting the boards 10 and 12 towards each other in an upward direction, as illustrated in FIGS. 5*a* to 5*c*. The angle θ between line AB and the vertical is herein referred to as a lip clearance angle. The lip clearance angle θ can be generally defined as the angle which permits pivotal disengagement of the floor boards 10 and 12 in one of the upward or downward direction, while still providing sufficient contact surfaces between the tongue 14 and the groove 16 to counteract planar pulling-apart of the floor boards during factory sanding/varnishing operations.

It has been found that pivotal separation of the floor boards 10 and 12 can be achieved without risking breaking the tongue 14 or the lips 22 and 24 of the groove 16 for lip clearance angles θ up to about 20 degrees. It is understood that this upper limit may vary depending on the level of compressibility of the wood species used to form the floor hoards. For instance, soft wood species, such as pine, may permit slightly greater lip clearance angle. It has also been noticed that the effort required to pivotally separate the floor boards 10 and 12 noticeably increases for clearance angles θ greater than 16 degrees. A 16 degrees lip clearance angle corresponds for instance to a 0.07 inch long top contact line AC for a 0.240 inch groove opening (i.e. distance between top and bottom lips 22 and 24 of the groove 16) in the example illustrated in FIG. 2.

It has also been found that if the lip clearance angle θ becomes too small (i.e. the distance between the top outermost and innermost contact point A and C in FIG. 2), the planar retention benefit afforded by the frictional engagement of the tongue 14 in the groove 16 is lost. Such a planar retention lost should be avoided in order to prevent disengagement of the floor boards 10 and 12 during the sanding and varnishing operations. Tests have shown that the floor boards become subject to coplanar separation during factory sanding and varnishing operation for tip clearance angles smaller than about 12 degrees. This corresponds to a 0.05 inch long top contact line AC for a 0.240 inch groove opening. The best results (i.e. easy pivotal separation with good planar retention) have been obtained for a lip clearance angle of about 14 degrees. In FIG. 2, this can also be expressed in term of a ratio between the length of the top contact surface (length of line AC) and the width or opening of the groove 16. A 14 degrees lip clearance angle corresponds to a 1/4 ratio. For instance, for a groove having a 0.240 inch width or opening, line AC would be 0.060 inch long.

In the embodiment illustrated in FIG. 2, the desired lip clearance angle θ is obtained by machining an undercut 26 in the outermost edge portion of the undersurface of the top lip 22 of the groove 16. As will be seen hereinafter, the undercut 26 may have several configurations. The undercut 26 defines a play P to permit withdrawal of the tongue 14 from the groove 16 via a relative upward pivotal movement of the floor boards 10 and 12. For instance, a 0.05 inch play P can be used for 0.240 inch groove opening and a 0.06 inch top contact line AC (i.e. 14 degrees lip clearance angle). With such a tongue and groove configuration, the tongue 14 can be tightly received in the groove 16 to provide strong planar retention of the floor boards 10 and 12 while allowing for easy pivotal separation of the floor boards 10 and 12 in the upward direction, as illustrated by arrows R1. However, any attempts at separating the floor boards 10 and 12 by means of downward pivotal movement, as represented by arrows R2, will be blocked by the contact points C and D. The line CD has not been altered by the modification made in the groove upper lip 22. As can be appreciated in FIG. 2, line CD is significantly longer than line AB and way too long compared to the groove opening to permit any downward pivotal movement of the tongue 14 in the groove 16.

Accordingly, the pivotal movement of the tongue 14 in the groove 16 has been unlocked in only one direction (i.e. the upward direction).

Figure 3:
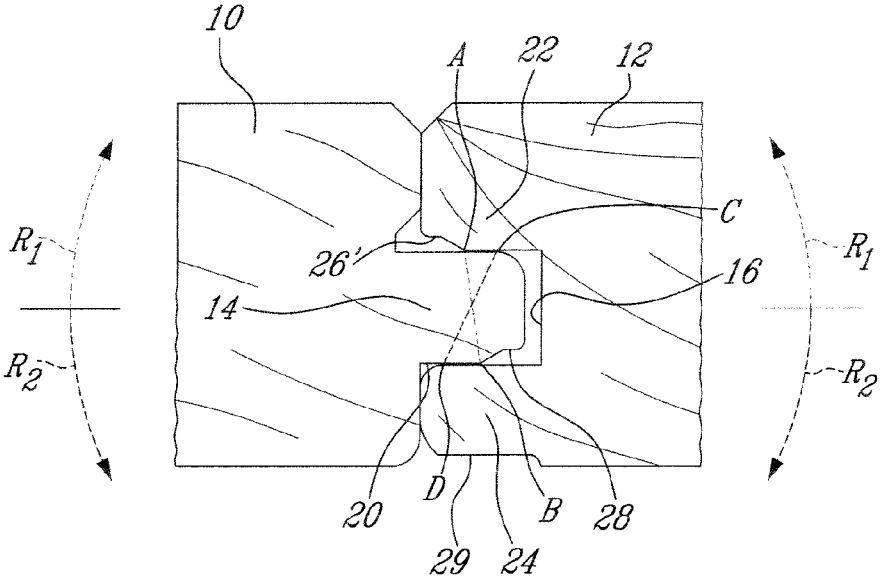
FIG. 3 is a cross-sectional view of a floorboard assembly illustrating another possible way of providing a lip clearance angle for enabling pivotal disassembly of two adjoining floor boards.

As shown in FIG. 3, the desired lip clearance angle θ can also be obtained by machining both the groove top lip 22 and the undersurface 20 of the tip portion of the tongue 14. According to this embodiment, the position of both the top outermost contact point A and of the bottom innermost contact point B is modified in order to reduce the length of line AB. The embodiment shown in FIG. 3 essentially differs from the embodiment of FIG. 2 by the addition of a second undercut 28 in the undersurface 20 of the tip of the tongue 14. The second undercut 28 displaces the bottom innermost contact point B away from the bottom of the groove 16 that is to the left hand side on FIG. 3. By so displacing the bottom innermost contact point B in an outward direction relative to the groove 16, the top outermost contact point A can be displaced to a lesser extend inwardly toward the bottom of the groove 16. By comparing FIGS. 2 and 3, it can be seen that the undercut 26' (FIG. 3) is not as deep as undercut 26 (FIG. 2). In contrast to the embodiment of FIG. 2 where only the top contact line AC is shortened, the total length reduction of the contact surfaces between the tongue 14 and the groove 16 is shared by both the top and bottom contact lines AC and DB (in a proportion of for instance 70% on the top contact surface and 30% on the bottom contact surface). According to the embodiment of FIG. 3, the resistance against planar separation of the floor boards 10 and 12 is more evenly shared by the top and bottom contact surfaces represented by lines AC and DB (in FIG. 2 the top contact surface AC is significantly shorter than the bottom contact surface DB). As for the first embodiment, the floor boards 10 and 12 can be easily pivotally disengaged from one another in the upward direction, as indicated by arrows R1. Pivotal disengagement or separation is however once again prevented in the downward direction (arrows R2) by the contact points C and D which are not affected by undercuts 26' and 28.

Figure 4:
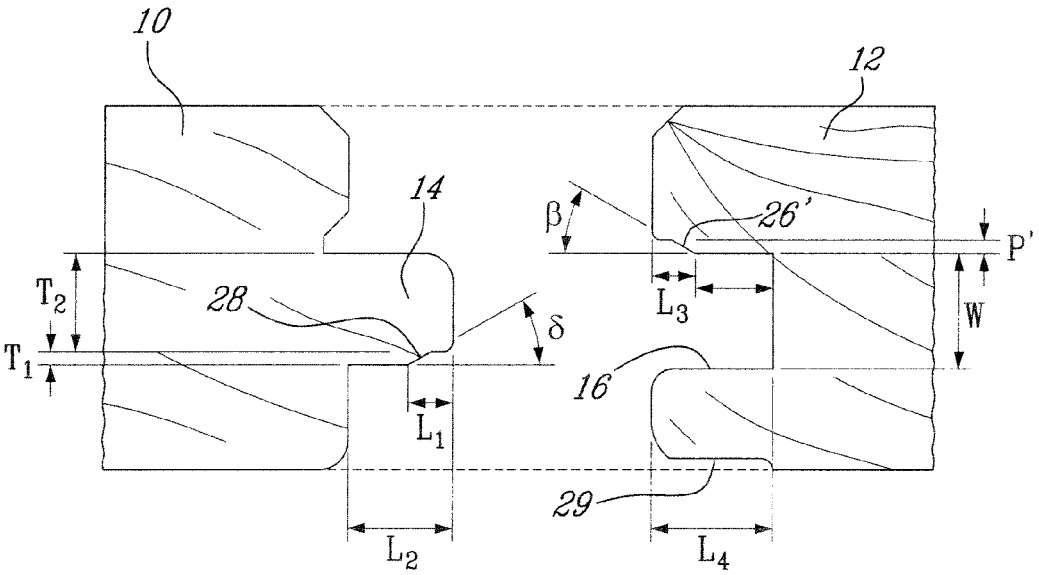
FIG. 4 is a cross-sectional view of the floor boards shown in FIG. 3 but illustrated in an unassembled state in order to illustrate some of the geometrical characteristics of the tongue-and-groove joint.

As shown in FIG. 3, a third undercut 29 can be defined in the undersurface of the bottom lip 24 along all the extent of the lip in a depth wise direction of the groove 16 (see L4 in FIG. 4). The third undercut 29 provides added flexibility of the bottom lip 24 to facilitate the insertion and the withdrawal of the tongue 14 in the groove 16. According to the illustrated embodiment, the third undercut 29 provides a bottom lip thickness reduction of about 0.020 inch to about 0.030. The play created by the third undercut 29 facilitates the insertion of the bottom lip 24 of the groove 16 underneath the tongue 14 after the board 10 has been nailed down to the sub floor structure. The third undercut can also compensate for expansion of the tongue 14 or of the groove lips due to environmental factors such as humidity. The third undercut 29 also contributes to minimise the risk of breaking the groove lips or the tongue when a board has to be removed.

FIG. 4 shows some of the geometrical details of the embodiment of FIG. 3. The length L1 of the second undercut 28 can represent about 15% to about 30% of the length L2 of the tongue 14. The reduction in the tongue thickness T1 can represent about 5% to about 20% of the total thickness T2 of the tongue 14. The transition angle δ defined by the undercut 28 can be about 10 to 50 degrees.

The length L3 of the lip undercut 26' can represent 15% to 30% of the length or deepness L4 of the groove 16. The play P' defined by the first undercut 26' can represent 5% to 20% of the width W of the groove 16. A play P' of at least 0.020 inch can be made in the undersurface of the upper lip of groove 16 for a 0.240 inch groove width W. The transition angle β defined by the undercut 26' can be about 10 to 50 degrees.

FIGS. 5*a* and 5*c* illustrate the procedure for pivotally separating the floor boards 10 and 12 shown in FIGS. 3 and 4. One has simply to grab the boards 10 and 12 by the sides thereof opposite to their adjoining edges and to exert an upward folding or pivoting action, as represented by arrows R1. The width of each floor boards 10 and 12 acts as a lever to facilitate the relative pivotal movement of the floor boards 10 and 12 about an initial point of pivot corresponding to a point of contact 30 between the top upper lip 22 of floor board 12 and the confronting side face of the other floor board 10. The lip undercut 26' and the tongue undercut 28 provide the required clearance to permit the angular withdrawal movement of the tongue 14 from the groove 16, thereby allowing for easy separation of the floor boards 10 and 12, as shown in FIGS. 5*b* and 5*c*.

Figure 6A:
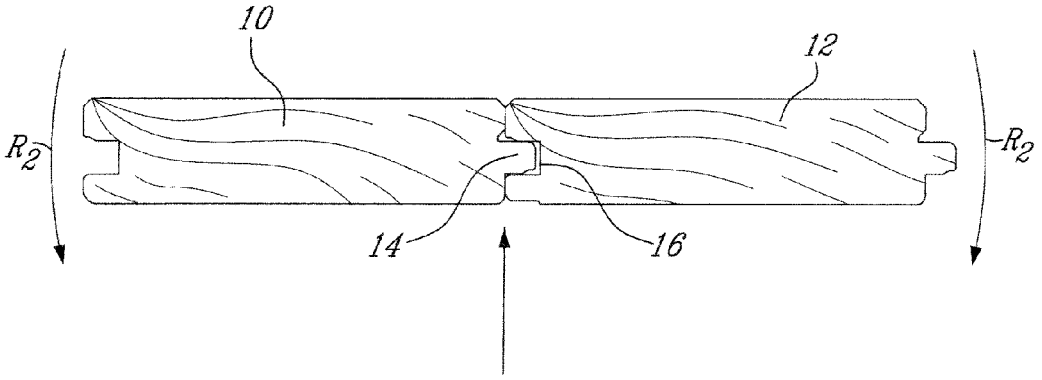
FIGS. 6*a* and 6*b* are cross-sectional views illustrating the retaining action between the floor boards of FIG. 3 when subject to downward bending forces as well as the retaining action when subject to pull apart forces exerted in the plane of the floor boards.
Figure 6B:
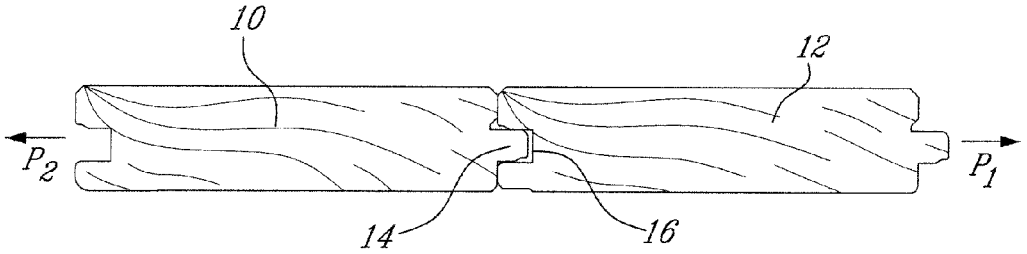

However, if downward pivotal efforts are applied on the floor boards 10 and 12 as represented by arrows R2 in FIG. 6*a* or if manual pull-apart forces P1 and P2 are applied in the plane of the floor boards 10 and 12 as shown in FIG. 6*b*, the tight fit engagement of the tongue 14 in the groove 16 will restrain the board against becoming disengaged from one another, as explained hereinbefore.

Figure 7A:
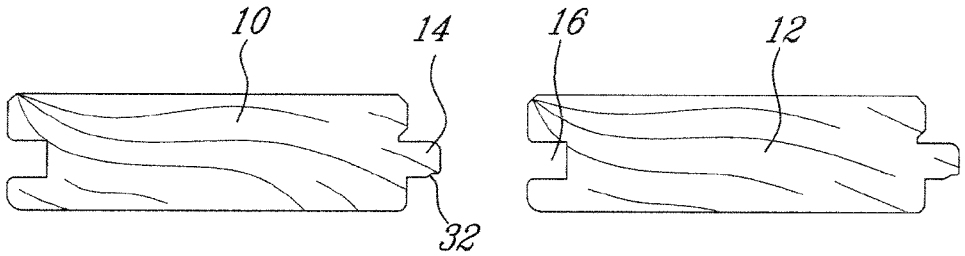
FIGS. 7*a* to 7*c* illustrate various ways of providing the lip clearance angle required to permit withdrawal of the tongue from the groove in response to a relative pivotal movement of the floor boards.
Figure 7B:
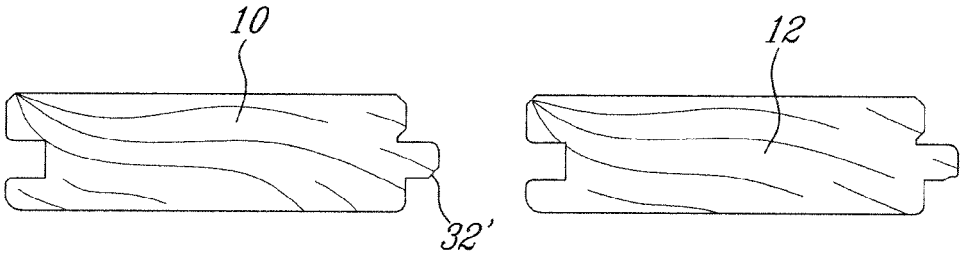
Figure 7C:
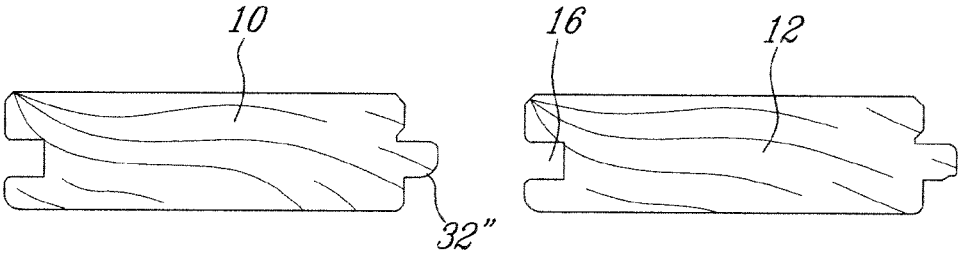

FIGS. 7*a* and 7*c* illustrate various possible tongue and groove configurations that could be implemented to provide a desired lip clearance angle θ between the tongue and the groove of adjacent floor boards. FIGS. 7*a* and 7*c* are not intended to constitute an exhaustive representation of all the possible alternatives. A person skilled in the art will understand that various permutations or combinations of the illustrated undercut arrangements can be provided to permit pivotal disengagement of the floor boards, in one of an upward or downward direction while still restraining linear removal of a board tongue from the associated groove of an adjacent board.

Now referring more particularly to FIGS. 7*a* to 7*c*, it can be seen that the upward pivotal movement can also be unlocked by solely adding one undercut 32, 32' or 32" in the undersurface of the tip portion of the tongue 14.

Irrespective of their emplacement (on the tongue or the lip of the groove) the undercut can have various profiles. For instance, the undercut can have a stepped profile (FIG. 7*a*), a slanted or bevel profile (FIG. 7*b*), or a rounded or arc profile (FIG. 7*c*). These profiles as well as other suitable profiles could also be applied to the undercut 26 defined in the undersurface of the groove upper lip 22 shown in FIG. 2. The person skilled in the art will understand that a wide variety of profiles could be adopted.

Figure 8:
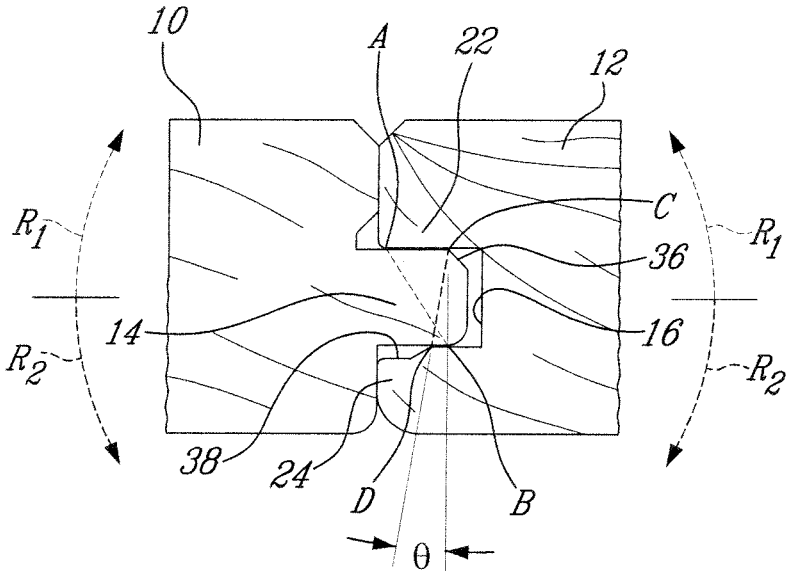
FIG. 8 is a cross-sectional view of a downwardly pivotally separable floor board assembly in accordance with a further embodiment of the present invention.

FIG. 8 illustrates one example of a downwardly pivotable tongue and groove arrangement.

According to this embodiment, the diagonal AB remains unchanged as compared to line AB on FIG. 1. The length of line AB is significantly longer than the width of the groove 16 and thus upward pivotal movement, as represented by arrows R1, of the tongue 14 in the groove 16 is impossible without breaking the tongue 14 or the lips 22 and 24 of the groove 16. However, relative downward pivotal movement of the floor boards 10 and 12 as represented by arrows R2 is rendered possible by the shortening of the contact line CD. In the illustrated example, the shortening is accomplished by means of a slanted undercut 36 on the top of the tip portion of the tongue 14 and a two-step undercut 38 on the outmost portion of the top surface of the bottom lip 24 of the groove 16. The lip clearance angle θ is defined between line CD and the vertical and like the lip clearance angle for unlocking the upward pivotal movement, it is comprised in range extending from about 12 degrees to about 20 degrees.

The above described tongue and groove arrangement is advantageous in that it can be "retrofitted" or adapted to any conventional tongue and groove arrangements. Also, it does not necessitate the purchase of any special tooling apart from new cutting knives having a cutting edge profile corresponding to the additional undercuts to be defined in the floorboards. It also facilitates the verification of the planarity between two adjoining boards since the tongue and groove engagement can be made very tight. The above described tongue and groove arrangement also reduces the likelihood that the floorboards being returned to the manufacturer by the installers because the boards are too difficult to separate from one another. It also contributes to improve the quality of the finish of factory finished floor boards by ensuring a greater integrity of the connection between the boards during the sanding and varnishing operations.

Still further embodiments and modifications of the present invention are available. The scope of the appended claims is not intended to be limited, therefore, only to the specific exemplary embodiments described above.

The invention claimed is:

1. A floorboard assembly comprising: at least first and second hardwood floor boards adapted to be mounted in a side-by-side coplanar relationship, the first floor board having a tongue extending longitudinally along a first side thereof, the second floor board having a groove extending longitudinally along a second side thereof, the groove having a width defined between a top lip and a bottom lip, the tongue being linearly insertable and removable from the groove while the first and second floor boards are coplanar, the tongue being received in a tight fit manner in the groove, a top surface of the tongue being in frictional engagement with an undersurface of the top lip of the groove from a top outermost contact point to a top innermost contact point relative to a depth of the groove, a bottom surface of the tongue being in frictional engagement with a top surface of the bottom lip of the groove from a bottom outermost contact point to a bottom innermost contact point relative to the depth of the groove, the frictional engagement of the top surface of the tongue depending at least on a distance between the top outermost contact point and the top innermost contact point, the frictional engagement of the bottom surface of the tongue depending at least on a distance between the bottom outermost contact point and the bottom innermost contact point, the frictional engagement of the top and bottom surfaces providing sufficient frictional resistance to resist against translational separation of the first and second floor boards in a common plane thereof when subject to pull-apart forces of a magnitude similar to that encountered during factory sanding operations, the top outermost contact point and the bottom innermost contact point defining a first diagonal, the top innermost contact point and the bottom outermost contact point defining a second diagonal, the first and second diagonals defining slopes of opposite sign, one of said first and second diagonals having a length sufficiently greater than the width of the groove to substantially lock the first and second floor boards against relative pivotal movement in one of an upward and a downward direction associated with said one of said first and second diagonals, a clearance provided between the tongue and the groove, the clearance reducing the length of the other one of said first and second diagonals to approximate the width of the groove to permit an angular withdrawal of the tongue from the groove by manually pivoting the first and second boards toward each other in the other one of said upward and downward directions, and means for providing added flexibility in the bottom lip of the groove, said means including an undercut defined in an undersurface of the bottom lip, the undercut extending substantially along the full extent of the bottom lip in a depthwise direction of the groove.

2. The floorboard assembly defined in claim 1, wherein the other one of said first and second diagonals defines a lip clearance angle with respect to the vertical, said lip clearance angle being comprised in a range of about 12 to about 20 degrees.

3. The floorboard assembly defined in claim 2, wherein the lip clearance angle is comprised in a range of about 12 to about 16 degrees.

4. The floorboard assembly defined in claim 3, wherein the lip clearance angle is about 14 degrees.

5. The floorboard assembly defined in claim 1, wherein the clearance reduces the length of the first diagonal, and wherein a ratio of the distance between the top outermost contact point and the top innermost contact point relative to the width of the groove is about 0.25.

6. The floorboard assembly defined in claim 1, wherein the clearance reduces the length of the second diagonal, and wherein the width of the groove is about 4 times greater than the distance between the bottom outermost contact point and the bottom innermost contact point.

7. The floorboard assembly defined in claim 1, wherein the clearance is provided by at least one clearance undercut defined in at least one of a top and a bottom tip portion of the tongue and an outermost portion of the undersurface of the top lip and a top surface of the bottom lip of the groove.

8. The floorboard assembly defined in claim 7, wherein the at least one clearance undercut comprises a first undercut defined in the undersurface of the outermost portion of the top lip of the groove, and a second undercut defined in the undersurface of the bottom tip portion of the tongue.

9. The floorboard assembly defined in claim 7, wherein the at least one undercut comprises a first undercut defined in the top surface of the tip portion of the tongue, and a second undercut defined in the outermost portion of the top surface of the bottom lip of the groove.

10. The floorboard assembly defined in claim 1, wherein the undercut provides a 0.020 inch to 0.030 inch reduction of the thickness of the bottom lip.

11. The floorboard assembly defined in claim 1, wherein the clearance has a dimension which represents 5% to 20% of the width of the groove.

12. The floorboard assembly defined in claim 11, wherein the clearance includes a 0.020 inch undercut in an outermost portion of the undersurface of the top lip of the groove.

13. The floorboard assembly defined in claim 8, wherein the second undercut has a length L1 representing about 15% to about 30% of a total length L2 of the tongue.

14. The floorboard assembly defined in claim 8, wherein the second undercut has a thickness T1 representing about 5% to about 20% of a total thickness T2 of the tongue.

15. The floorboard assembly defined in claim 8, wherein the first undercut has a length L3 representing 15% to 30% of a total length L4 of the groove.

16. A pre-finished floorboard assembly comprising at least first and second solid wood floor boards, the first floor board having a tongue extending longitudinally along a first side thereof, the second floor board having a groove extending longitudinally along a second side thereof, the groove having a width defined between a top lip and a bottom lip, the tongue being linearly inserted in frictional engagement in the groove while the floor boards are coplanar to counteract pull-apart forces exerted on the first and second floor boards during factory sanding and varnishing operations, the first and second floor boards being linearly disengageable while being held in a common plane by overcoming a frictional resistance offered by a tight fit engagement of the tongue in the groove, at least one play provided between the tongue and the groove at at least one of a tip portion of the tongue and an outermost portion of the top and bottom lips relative to a depth of the groove, the play being configured to allow the tongue to be angularly withdrawn from the groove by manually pivoting the first and second floor boards towards one another in only one of an upward and a downward direction, and means for providing added flexibility in the bottom lip of the groove, said means including an undercut defined in an undersurface of the bottom lip, the undercut extending substantially along the full extent of the bottom lip in a depthwise direction of the groove.

17. The pre-finished floorboard assembly defined in claim 16, wherein a top surface of the tongue is in frictional engagement with an undersurface of the top lip of the groove between a top outermost contact point and a top innermost contact point relative to the depth of the groove, a bottom surface of the tongue being in frictional engagement with a top surface of the bottom lip of the groove between a bottom outermost contact point and a bottom innermost contact point relative to the depth of the groove, the top outermost contact point and the bottom innermost contact point defining a first diagonal, the top innermost contact point and the bottom outermost contact point defining a second diagonal, and wherein the presence of the play has for effect of pivoting one of said first and second diagonals closer to the vertical such that said one diagonal has a length approximating the width of the groove, the first and second diagonals having slopes of opposite sign.

18. The pre-finished floorboard assembly defined in claim 17, wherein said one of said first and second diagonals defines a lip clearance angle with respect to the vertical, said lip clearance angle ranging from about 12 degrees to about 20 degrees.

19. The floorboard assembly defined in claim 18, wherein the lip clearance angle ranges from about 12 degrees to about 16 degrees.

20. The floorboard assembly defined in claim 19, wherein the lip clearance angle is about 14 degrees.

* * * * *